US006804843B1

(12) United States Patent
Hung

(10) Patent No.: US 6,804,843 B1
(45) Date of Patent: Oct. 19, 2004

(54) FLUSH TANK CAPABLE OF RECEIVING WASTE WATER

(76) Inventor: Sheng Fu Hung, P.O. Box 63-99, Taichung (TW), 406

( * ) Notice: Subject to any disclaimer, the term of this patent is extended or adjusted under 35 U.S.C. 154(b) by 0 days.

(21) Appl. No.: 10/402,798

(22) Filed: Mar. 26, 2003

(51) Int. Cl.[7] ..... A47K 4/00

(52) U.S. Cl. ..... 4/665; 4/381; 4/382; 4/393; 4/413; 4/414

(58) Field of Search ..... 4/665, 664, 381, 4/382, 392, 393, 413, 414, 324, 325, 326, 327

(56) References Cited

U.S. PATENT DOCUMENTS 578,803 A * 3/1897 Wood ..... 4/382
827,716 A * 8/1906 Eastwood ..... 4/381
1,302,154 A * 4/1919 Griffiths ..... 4/381
1,736,719 A * 11/1929 Norman ..... 4/382
1,952,583 A * 3/1934 Coltman ..... 4/381
5,425,146 A * 6/1995 Serrano ..... 4/665
5,754,986 A * 5/1998 Chien ..... 4/327

* cited by examiner

*Primary Examiner*—Gregory L. Huson
*Assistant Examiner*—Khoa D. Huynh

(57) ABSTRACT

A flush tank includes a water entrance to receive water from a water reservoir, a water outlet for discharging the water and controlled by a valve member, and a water inlet disposed in the upper portion to receive waste water from waste water suppliers. A valve device is attached to the lower portion of the tank member, to control and to allow little water to flow into the tank member via the water entrance. Another valve device is attached to the upper portion of the tank member, to control and to allow the waste water to flow into and to fill the tank member via the water inlet.

6 Claims, 6 Drawing Sheets

FLUSH TANK CAPABLE OF RECEIVING WASTE WATER

BACKGROUND OF THE INVENTION

1. Field of the Invention

The present invention relates to a flush tank, and more particularly to a flush tank having a waste water receiving system.

2. Description of the Prior Art

Various kinds of typical flush tanks have been developed for flushing purposes, and comprise a single water inlet coupled to a water reservoir, to receive fresh or clean water from the water reservoir.

In order to save water, some of the typical flush tanks have been developed to provide one or more control devices, in order to control the water discharge quantity, and so as to flush different objects. However, the typical flush tanks are also required to be supplied with the fresh or clean water from the water reservoir, and may not receive waste water from different waste water generators or suppliers.

For example, much waste water may be contained in or discharged from the washbowls or washbasins everyday. However, the waste water is all discharged and may not be recycled or may not be used. Particularly, the waste water discharged from the washbowls or washbasins everyday may not be suitably recycled or used again.

Similarly, in swimming pools, much waste water may also be generated and discharged everyday. However, the waste water also may all be discharged and may not be recycled or may not be used, and may not be supplied into the flush tanks for flushing purposes.

The present invention has arisen to mitigate and/or obviate the afore-described disadvantages of the conventional flush tanks.

SUMMARY OF THE INVENTION

The primary objective of the present invention is to provide a flush tank including a waste water receiving system to receive waste water from various water suppliers or generators or reservoirs, to receive and use the waste water for flushing purposes.

In accordance with one aspect of the invention, there is provided a flush tank comprising a tank member including a water entrance for coupling to a water reservoir and to receive water from the water reservoir, the tank member including a lower portion having a water outlet provided therein, and including an upper portion having a water inlet for receiving waste water, a first valve device attached to the lower portion of the tank member, to control the water entrance, and to allow little water to flow into the tank member via the water entrance, a valve member rotatably secured to the tank member with a pivot pin, to allow the valve member to be rotated relative to the tank member and to either open or enclose the water outlet of the tank member, a second valve device attached to the upper portion of the tank member, to control the water inlet, and to allow the waste water to flow into and to fill the tank member via the water inlet, and a control device disposed in the tank member to open and close the water outlet of the tank member, and to control water flowing out through the water outlet of the tank member.

The control device includes an arm pivotally secured to the tank member, a cable coupled between the arm and the valve member, to allow the arm to open the valve member via the cable, and a knob coupled to the arm to actuate the arm to open the valve member.

The control device further includes a lever pivotally secured in the tank member, the lever includes a first end having a retainer provided thereon to engage with the valve member, and to retain the valve member at an open position, and the lever includes a second end having a float provided thereon to selectively disengage the retainer from the valve member.

The control device further includes a bar having a first end pivotally secured in the tank member, the bar includes a second end having a weight provided thereon to engage with the float, and to depress the float, and to disengage the retainer from the valve member. The control device further includes a cable coupled between the arm and the bar, to allow the arm to rotate the bar, and to disengage the weight from the float.

The control device includes a beam having a middle portion pivotally secured to the tank member and having a first end and a second end, and a cable coupled between the first end of the beam and the valve member, to allow the beam to open the valve member via the cable. The control device includes a button attached to the second end of the beam to actuate the beam to open the valve member via the cable.

A waste water supplier may further provided and may include an exit coupled to the water inlet of the tank member. A water container may further provided to receive the waste water, and may be coupled to the water inlet of the tank member to supply the waste water into the tank member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
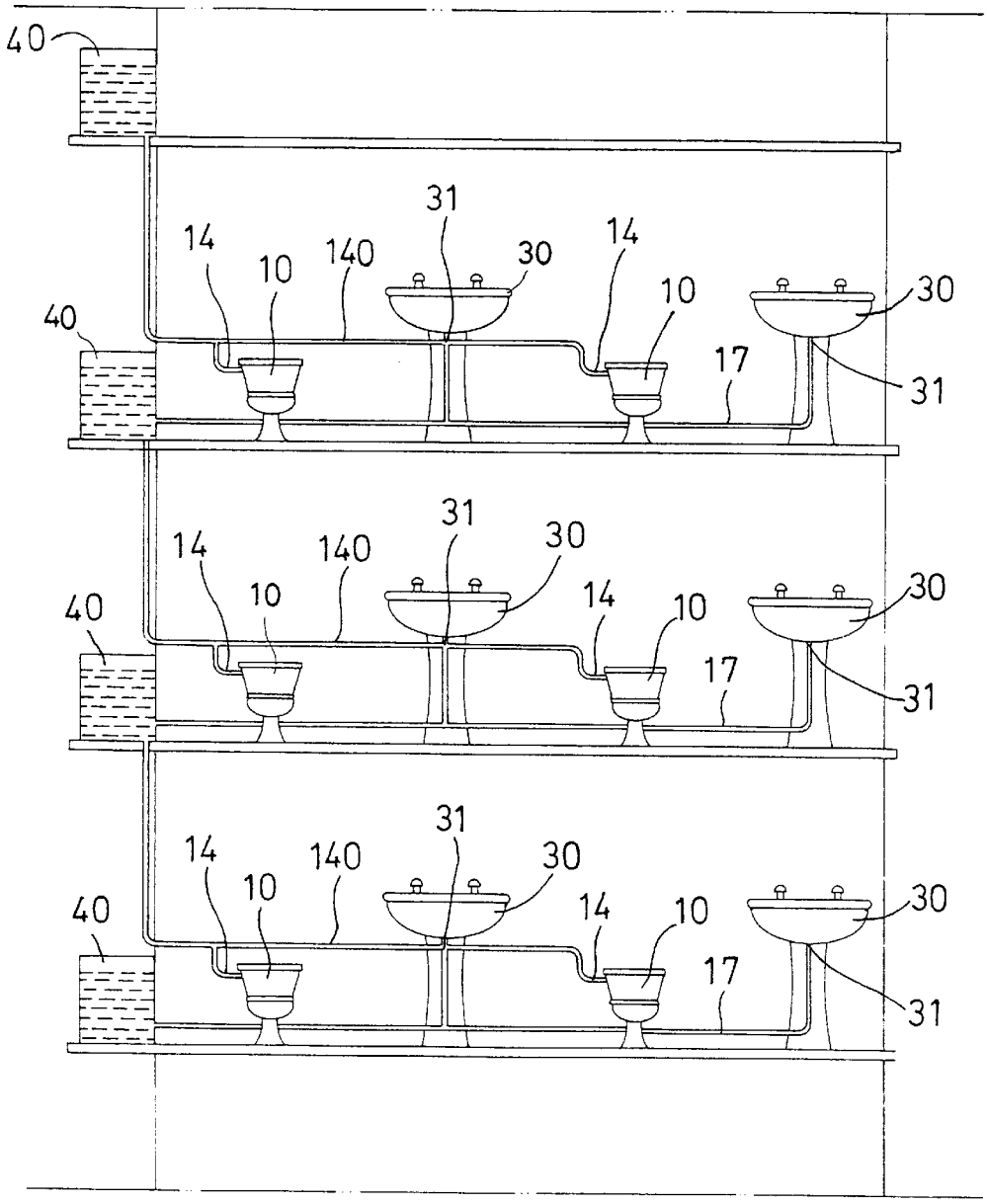
FIG. 1 is a plan schematic view of a flush tank having a waste water receiving system in accordance with the present invention.
Figure 2:
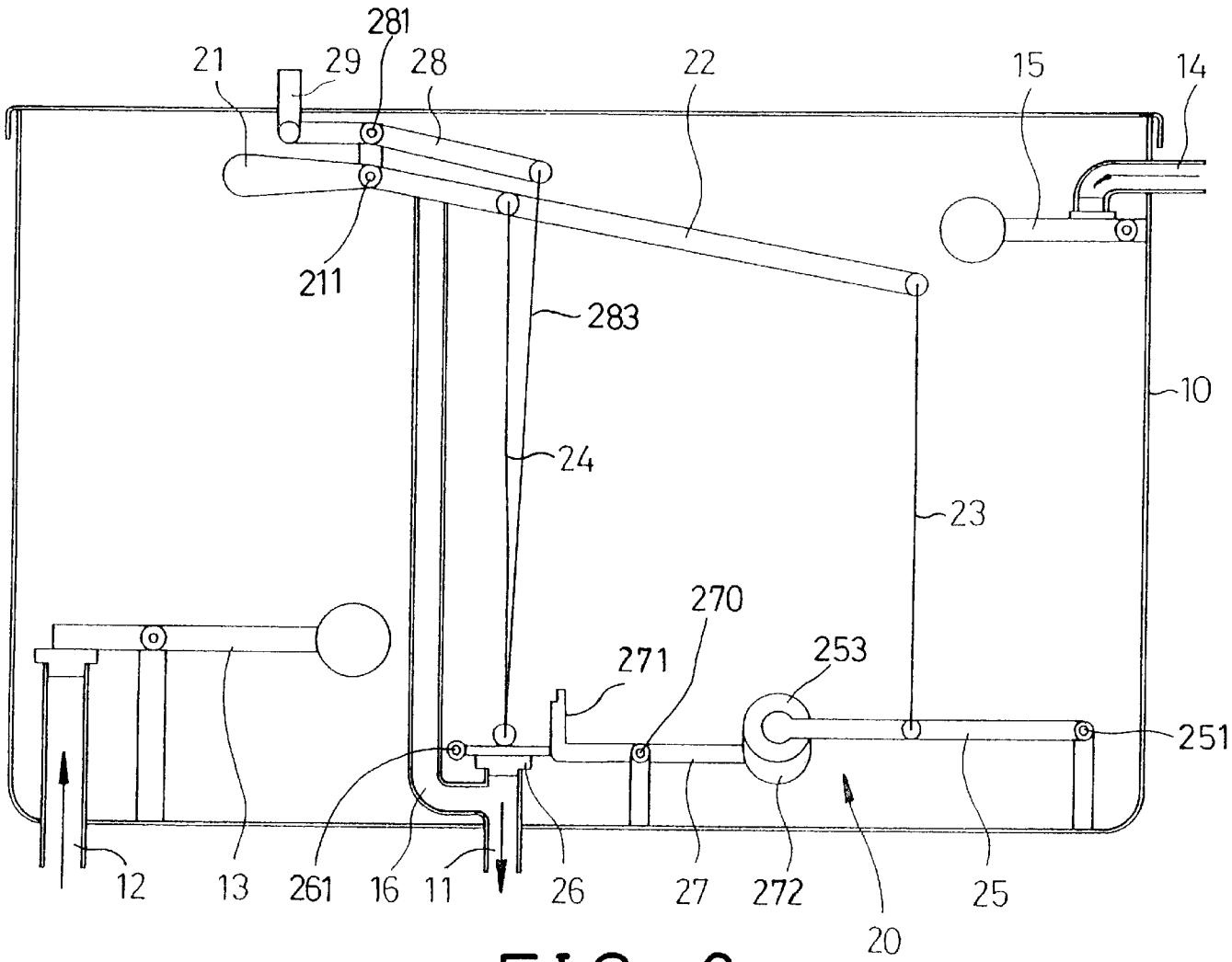
FIG. 2 is a cross sectional view of the flush tank.
Figure 6:
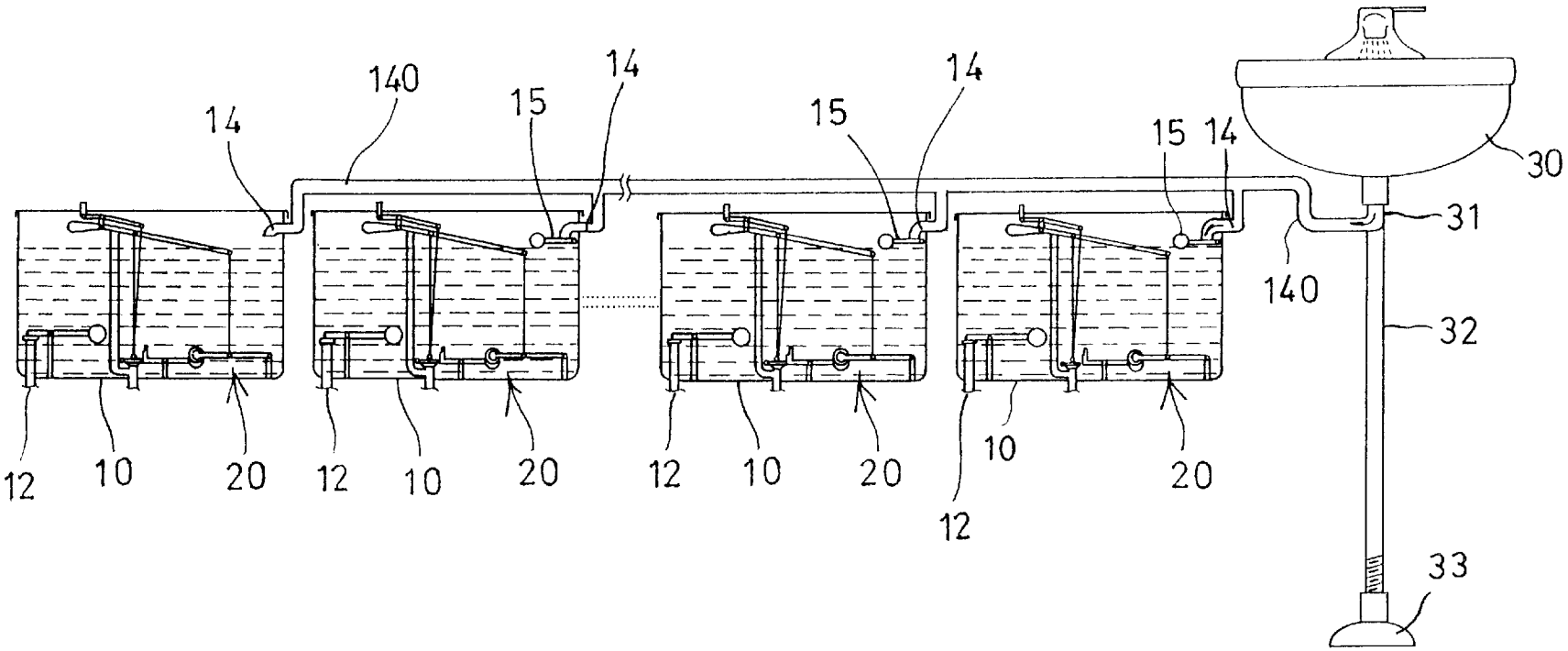
FIG. 6 is a plan schematic view illustrating the other arrangement of the flush tank.

Referring to the drawings, and initially to FIGS. 1 and 2, a flush tank assembly in accordance with the present invention comprises one or more tank bodies 10 that may be disposed and coupled together in series (FIGS. 1, 6). However, only one of the tank bodies 10 will be described hereinafter.

As shown in FIG. 2, the flush tank body 10 includes an outlet 11 to discharge water for flushing purposes, and includes a water entrance 12 coupled to a water reservoir of such as house families, to receive water from the water reservoir. A valve device 13 is provided to control the water flowing into the tank body 10 via the water entrance 12.

Figure 3:
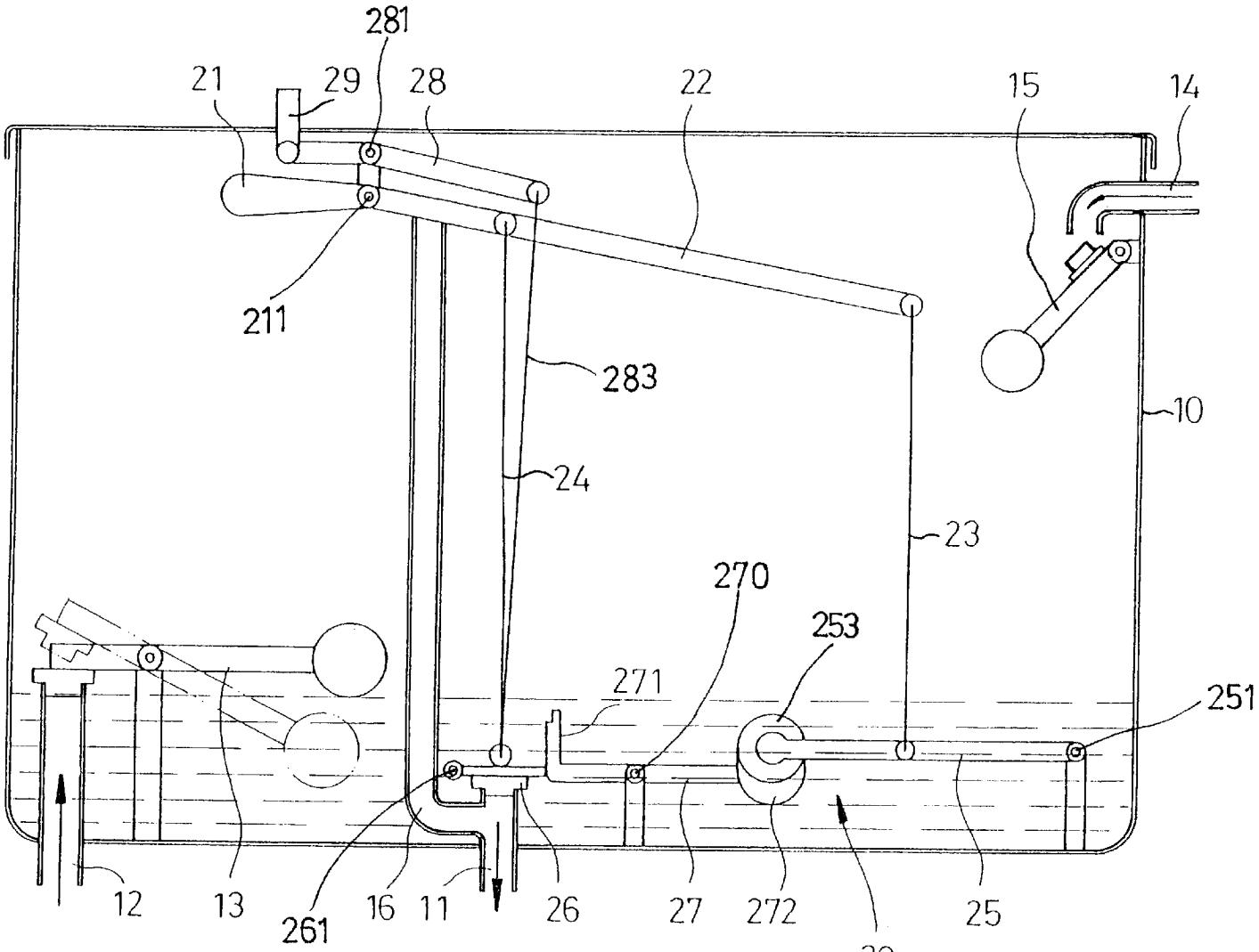
FIGS. 3, 4, 5 are cross sectional views similar to FIG. 2, illustrating the operation of the flush tank.

Particularly, the valve device 13 is disposed in the lower portion of the tank body 10, to receive little water from the water reservoir. For example, as shown in FIG. 3, the valve device 13 may be arranged to control about one third (⅓) or one fourth (¼) of water to be received or contained within the tank body 10. The typical flush tanks have no valve device that may be disposed in the lower portion of the tank body to control and to receive little water from the water reservoir.

The flush tank body 10 includes a water inlet 14 coupled to a waste water suppliers 30, such as the washbowls or washbasins 30 (FIGS. 1, 6), and/or the water containers 40 that may be disposed on each floor of buildings (FIG. 1). Another valve device 15 is provided to control the water flowing into the tank body 10 via the water inlet 14.

Figure 4:
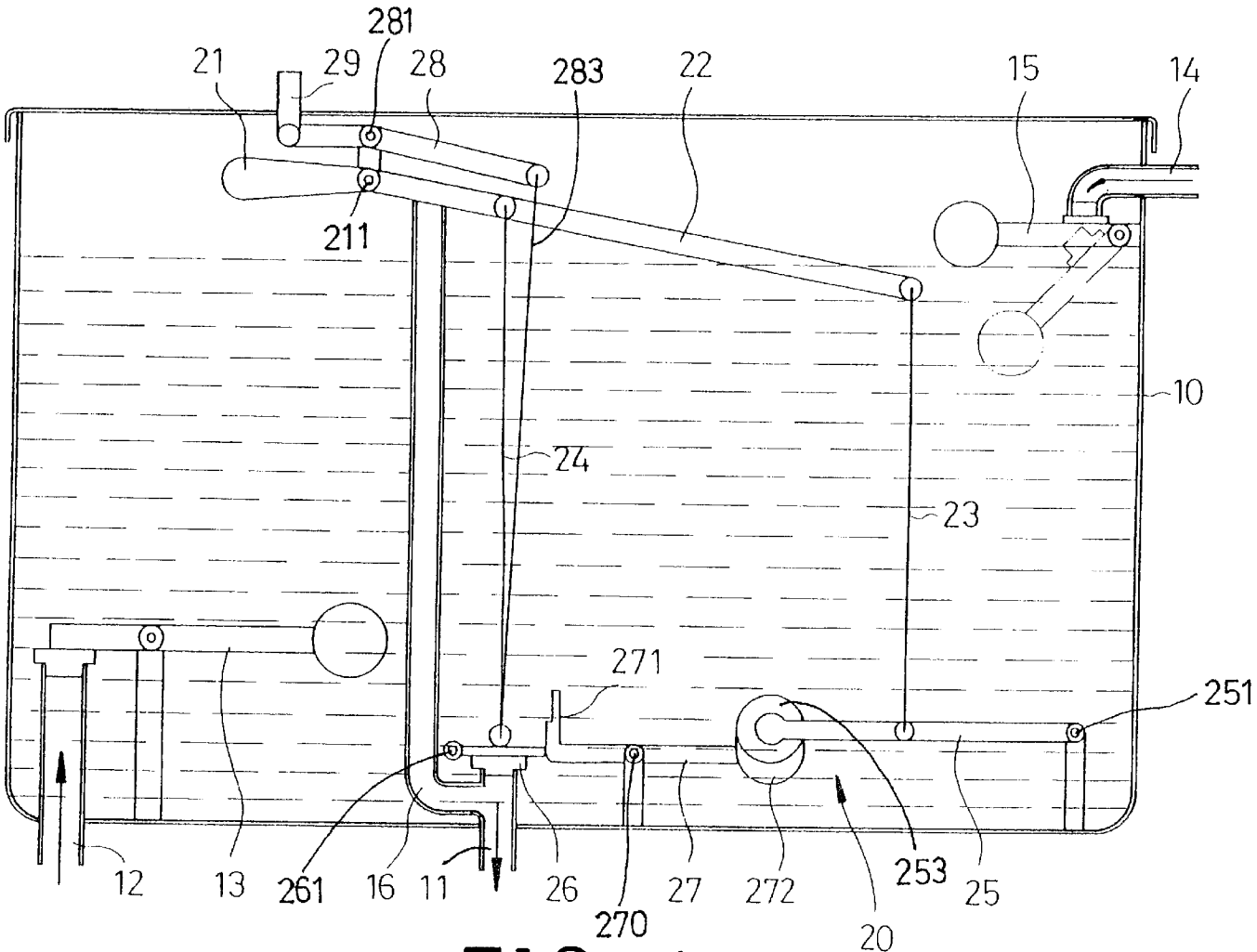

Particularly, the water inlet 14 and/or the valve device 15 may be disposed in the upper portion of the tank body 10, to receive much water from the water suppliers 30. For example, as shown in FIG. 4, the valve device 15 may be arranged to allow about four fifth (4/5) or full of water to be received or contained within the tank body 10, or to allow the water to fill the tank body 10.

The flush tank body 10 further includes a discharge tube 16 coupled to the water outlet 11 of the tank body 10, and having an upper portion extended toward the upper portion of the tank body 10, for allowing excess water to flow out of the tank body 10. For example, when the valve device 15 is out of order, much or excess water may flow into the tank body 10.

In operation, as shown in FIGS. 1 and 6, the waste water suppliers 30, such as the washbowls or washbasins 30 may include an exit 31 coupled to the water inlets 14 of the tank bodies 10 with pipes 140, for allowing the waste water from the waste water suppliers 30 to directly flow into the tank bodies 10.

As shown in FIG. 6, the washbowls or washbasins 30 may include a post 32 and an adjustable device 33 to adjust the height or position of the washbowls or washbasins 30 relative to the tank bodies 10, to allow the waste water to suitably flow from the waste water suppliers 30 to the tank bodies 10.

As also shown in FIG. 6, the last one of the tank bodies 10, or the farthest tank body 10 from the washbowls or washbasins 30 is not required to provide or attach a valve device therein. The other or previous tank bodies 10 are required to mount the valve devices 15, in order to stop the waste water, and to allow the waste water to flow into the last one of the tank bodies 10, or the farthest tank body 10 from the washbowls or washbasins 30.

As shown in FIG. 1, the washbowls or washbasins 30 may further be coupled to the water containers 40, to supply the waste water into the water containers 40 which may collect and store the waste water therein for further use. The water containers 40 may be coupled to the washbowls or washbasins 30 at the lower floors, or below the water containers 40, to supply the waste water to the washbowls or washbasins 30.

As shown in FIGS. 2–5, the tank body 10 further include a control device 20 to control the water flowing out of the tank body 10. The control device 20 includes a knob 21 and an arm 22 rotatably or pivotally secured to the tank body 10 with a pivot shaft 211, to allow the arm 22 to be rotated relative to the tank body 10 by the knob 21.

A valve member 26 is rotatably or pivotally secured to the tank body 10 with a pivot pin 261, to allow the valve member 26 to be rotated relative to the tank body 10 to either open or enclose the water outlet 11 of the tank body 10. A cable 24 is coupled between the arm 22 and the valve member 26, for allowing the arm 22 to directly open the valve member 26.

Figure 5:
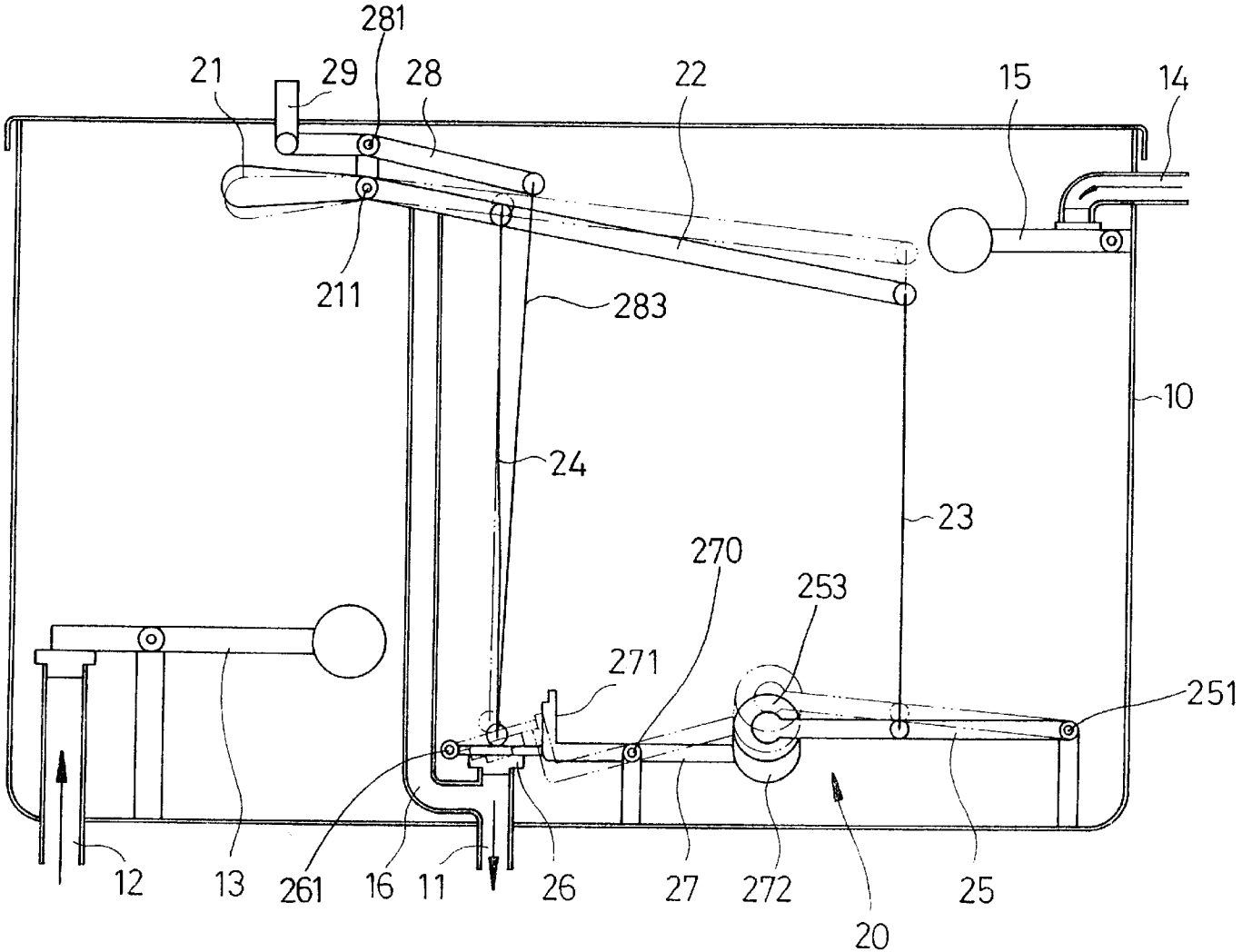

A lever 27 has a middle portion rotatably or pivotally secured to the tank body 10 with a pivot rod 270, and includes a retainer 271 provided on one end thereof to support and retain the valve member 26 at the open position, as shown in dotted lines in FIG. 5, and includes a float 272 provided on the other end thereof to disengage the retainer 271 from the valve member 26 when water level is lower than the float 272.

When the valve member 26 is opened by the arm 22 via the cable 24, and when the float 272 is released, as shown in dotted lines in FIG. 5, the valve member 26 may be engaged with and supported and retained at the open position by the retainer 271 of the lever 27, until the water level is lower than the float 272 or when a force is applied onto the float 272 to depress the float 272 upwardly or to force the retainer 271 of the lever 27 away from the valve member 26.

A bar 25 has one end rotatably or pivotally secured to the tank body 10 with a pivot axle 251, and includes a weight 253 attached to the other end thereof, for engaging with the float 272, to depress the float 272 downwardly. Another cable 23 is coupled between the bar 25 and the arm 22, for allowing the arm 22 to rotate the bar 25 and to elevate the weight 253 upwardly from the float 272, for allowing the retainer 271 of the lever 27 to engage with the valve member 26, and to retain or support the valve member 26 at the open position.

A beam 28 includes a middle portion rotatably or pivotally secured to the tank body 10 with a pivot pole 281, and includes one end coupled to the valve member 26 with another cable 283, for allowing the beam 28 to directly open the valve member 26. A button 29 may be attached to the other end of the beam 28 to actuate the cable 283 to open the valve member 26.

In operation, the valve member 26 may be opened by the button 29 and the beam 28 when the button 29 is depressed by the users, for allowing water to flow out through the water outlet 11. When the button 29 is released by the users, the water outlet 11 may be blocked or enclosed by the valve member 26, such that the users may control the water quantity flowing out through the water outlet 11.

Accordingly, the flush tank in accordance with the present invention includes a waste water receiving system to receive waste water from various water suppliers or generators or reservoirs, to receive and use the waste water for flushing purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A flush tank comprising:

a tank body including a water entrance for coupling to a water reservoir and to receive water from the water reservoir, said tank body including a lower portion having a water outlet provided therein, and including an upper portion having a water inlet for receiving waste water, a first valve device attached to said lower portion of said tank body, to control said water entrance, and to allow little water to flow into said tank body via said water entrance, a valve member rotatably secured to said tank body with a pivot pin, to allow said valve member to be rotated relative to said tank body and to either open or enclose said water outlet of said tank body, a second valve device attached to said upper portion of said tank body, to control said water inlet, and to allow the waste water to flow into and to fill said tank body via said water inlet, and a control device disposed in said tank body to open and close said water outlet of said tank body, and to control water flowing out through said water outlet of said tank body, said control device including an arm pivotally secured to said tank body, a cable coupled between said arm and said valve member, to allow said arm to open said valve member via said cable, and a knob coupled to said arm to actuate said arm to open said valve member, said control device further including a lever pivotally secured in said tank body, said lever including a first end having a retainer provided thereon to engage with said valve member, and to retain said valve member at an open position, and said lever including a second end having a float provided thereon to selectively disengage said retainer from said valve member, and said control device further including a bar having a first end pivotally secured in said tank body, said bar including a second end having a weight provided thereon to engage with said float, and to depress said float, and to disengage said retainer from said valve member.

2. The flush tank as claimed in claim 1, wherein said control device further includes a cable coupled between said arm and said bar, to allow said arm to rotate said bar, and to disengage said weight from said float.

3. The flush tank as claimed in claim 1, wherein said control device includes a beam having a middle portion pivotally secured to said tank body and having a first end and a second end, and a cable coupled between said first end of said beam and said valve member, to allow said beam to open said valve member via said cable.

4. The flush tank as claimed in claim 3, wherein said control device includes a button attached to said second end of said beam to actuate said beam to open said valve member via said cable.

5. The flush tank as claimed in claim 1 further comprising a waste water supplier including an exit coupled to said water inlet of said tank body.

6. The flush tank as claimed in claim 1 further comprising a water container coupled to said water inlet of said tank body.

* * * * *